US010519562B2

(12) United States Patent
Hou et al.

(10) Patent No.: US 10,519,562 B2
(45) Date of Patent: Dec. 31, 2019

(54) METHOD TO CREATE THIN FUNCTIONAL COATINGS ON LIGHT ALLOYS

(71) Applicants: Fengyan Hou, Auckland (NZ); Yuxin Wang, Jiangsu (CN); Bo Hu, Auckland (NZ); Christopher William Goode, Auckland (NZ); Junzhe Dong, Auckland (NZ)

(72) Inventors: Fengyan Hou, Auckland (NZ); Yuxin Wang, Jiangsu (CN); Bo Hu, Auckland (NZ); Christopher William Goode, Auckland (NZ); Junzhe Dong, Auckland (NZ)

(73) Assignee: Auckland Uniservices Limited, Auckland (NZ)

( * ) Notice: Subject to any disclaimer, the term of this patent is extended or adjusted under 35 U.S.C. 154(b) by 0 days.

(21) Appl. No.: 15/678,256

(22) Filed: Aug. 16, 2017

(65) Prior Publication Data

US 2018/0051388 A1 Feb. 22, 2018

Related U.S. Application Data

(60) Provisional application No. 62/376,029, filed on Aug. 17, 2016.

(51) Int. Cl.
*C25D 11/20* (2006.01)
*C25D 11/22* (2006.01)
(Continued)

(52) U.S. Cl.
CPC ..... *C25D 11/04* (2013.01); *C25D 5/18* (2013.01); *C25D 5/38* (2013.01); *C25D 5/42* (2013.01); *C25D 5/44* (2013.01); *C25D 11/08* (2013.01); *C25D 11/16* (2013.01); *C25D 11/20* (2013.01); *C25D 11/26* (2013.01); *C25D 11/30* (2013.01); *C25D 13/20* (2013.01); *C25D 21/08* (2013.01); *C25D 5/14* (2013.01); *C25D 11/10* (2013.01)

(58) Field of Classification Search
CPC ..... C25D 11/18–22
USPC ..... 205/171–173
See application file for complete search history.

(56) References Cited

U.S. PATENT DOCUMENTS 3,098,804 A 7/1963 Wittrock et al.
3,915,811 A 10/1975 Tremmel et al.
(Continued)

FOREIGN PATENT DOCUMENTS

EP 0368470 A1 5/1990

OTHER PUBLICATIONS

Al-Mill Specification from http://maxsteel.sg/pdf/aluminum_guide.pdf. (Year: 2012).*
(Continued)

*Primary Examiner* — Brian W Cohen

(57) ABSTRACT

In example implementations, a method for producing a thin film coating is provided. The method includes pre-treating a substrate, placing the substrate in a bath comprising at least phosphoric acid and sulphuric acid to produce a thin anodized layer, rinsing the thin anodized layer in a solution, plating a surface of the thin anodized layer in an electro deposition bath following a plating current profile for a predetermined period, and increasing the plating current to the recommended bath plating current to produce the thin film coating having a desired initial coating thickness.

12 Claims, 13 Drawing Sheets

(51) Int. Cl.

| | |
|---|---|
| ***C25D 5/44*** | (2006.01) |
| ***C25D 5/18*** | (2006.01) |
| ***C25D 11/04*** | (2006.01) |
| ***C25D 13/20*** | (2006.01) |
| ***C25D 21/08*** | (2006.01) |
| ***C25D 5/38*** | (2006.01) |
| ***C25D 5/42*** | (2006.01) |
| ***C25D 11/08*** | (2006.01) |
| ***C25D 11/16*** | (2006.01) |
| ***C25D 11/26*** | (2006.01) |
| ***C25D 11/30*** | (2006.01) |
| *C25D 5/14* | (2006.01) |
| *C25D 11/10* | (2006.01) |

(56) References Cited

U.S. PATENT DOCUMENTS 4,067,782 A 1/1978 Okinaka et al.
5,470,636 A * 11/1995 Wakui ..... C25D 11/18 204/192.1
6,407,047 B1 * 6/2002 Mehta ..... C23F 1/20 510/245
2002/0096434 A1 * 7/2002 Marczak ..... C25D 11/22 205/105
2007/0021298 A1 * 1/2007 Kunita ..... B01J 19/0093 502/325
2011/0117357 A1 * 5/2011 Hatanaka ..... H01L 24/29 428/312.8
2013/0153427 A1 * 6/2013 Tatebe ..... C25D 3/12 205/50

OTHER PUBLICATIONS

International Search Report and Written Opinion mailed in corresponding PCT Application No. PCT/IB2017/054972, dated Feb. 22, 2018, 13 pages.

Griffiths, S.K. et al., "An Aluminum Resist Substrate for Microfabrication by LIGA", Report by Sandia National Laboratories, Apr. 2005 (uploaded on May 26, 2014; accessed at https:www.researchgate.net/publication/236428170) pp. 1-26.

* cited by examiner

| ELEMENT | Wt% | At% |
|---|---|---|
| O K | 4.89 | 13.1 |
| AlK | 20.19 | 32.04 |
| SiK | 0.11 | 0.17 |
| FeK | 3.72 | 2.86 |
| NiK | 71.08 | 51.84 |
| TOTAL | 100 | 100 |

METHOD TO CREATE THIN FUNCTIONAL COATINGS ON LIGHT ALLOYS

CROSS REFERENCE TO RELATED APPLICATIONS

This application claims priority to U.S. Provisional Patent Application Ser. No. 62/376,029, filed Aug. 17, 2016, which is herein incorporated by reference in its entirety.

BACKGROUND

Aluminium and its alloys are a widely used material for automotive, structural and aerospace applications, however without suitable functional coatings many alloys suffer from environmental degradation due to corrosion. A number of processes have been developed to protect aluminium surfaces including anodizing, plating and chemical films. However, to effectively protect the aluminium surface either a thick plated or anodized film is required. Alternatively, thin films of environmentally hazardous materials such as cadmium or hexavalent chromium are required.

Anodizing is one well recognized method to protect aluminium and other light metal surfaces. Different applications of an anodized surface may utilize either a thick film, where high protection is required, or a thin film for more decorative applications. In thick film or hard anodizing an oxide surface between 25 and 150 microns thick is developed. This surface is typically sealed in a process that may include dying. Other protective coatings may be subsequently applied to this surface. Two patents U.S. Pat. Nos. 4,431,707 and 4,624,752 describe methods to further treat hard anodized surfaces so that they may be plated. Both of these methods include a chemical etch phase to create a layer to which an electrically conductive surface may be applied and plated layers electrodeposited on this surface.

Thin film anodized surfaces are typically between 0.5 and 25 microns. As with hard anodizing these surfaces are normally sealed to provide environmental protection. An advantage of thin anodized surfaces is that sufficient electrical conductivity remains between the substrate through the anodizing pores that it is possible to directly electrodeposit functional films on the anodized surface. Patents U.S. Pat. Nos. 3,915,811 and 3,943,039 describe methods to further treat anodized films and electro deposit, especially nickel coatings, on such films. These patents specify different baths and processes for the anodizing while suggesting a variety of approaches to electro-deposition to provide a functional surface. Both these patents are directed at a subset of aluminium alloys of particular importance to the automotive industry for car bumpers and typically involve electro-depositing one or more thick layers to achieve the corrosion protection and decorative aspects of these applications. More specifically these patents do not teach the approach disclosed in this application to ensure complete filling of the anodizing pores and allow thin film electrodeposited surfaces to achieve good corrosion protection and other functional properties.

Electro-deposition on aluminium is also well known and the process typically involves applying a very thin zinc layer to the surface using a zincate process followed by applying one or more plated coatings on this surface. The zincate process is inherently problematic and essential to achieve a good electrodeposited coating, thus double and triple zincate steps are often required to achieve acceptable results. In many instances, the first plated layer is a thick (40-50 microns) electro-less Ni—P coating or semi-bright electrolytic nickel to provide corrosion protection. This first layer is followed by a functional or decorative surface layer which may be a bright nickel. In one application, the surface coating is electro-deposited Zn—Ni. The Ni—P/Zn—Ni coating system has been developed to replace environmentally dangerous chromate passivated cadmium for electrical connector shells. However, the process is both expensive in time and materials and not as effective as the coating it is designed to replace.

Thin anodized films are also used as a template to produce nano-wires for sensors, such as that described in US 2009/0242416. While this patent teaches plating in the pores of an anodized surface it does not teach controlling the current to ensure complete filling of the nano-pores and achieving an interlock between the nano-wire and the pore. Nor does it teach increasing the current when the pores are filed to ensure complete coverage of the anodized film.

Consequently, there is a need in the art for a method to coat aluminium and other light metal surfaces with thin plated coatings that provides protection from corrosion and other functional attributes.

SUMMARY

According to aspects illustrated herein, there is provided a method for producing a thin film coating. One disclosed feature of the embodiments is a method comprising pretreating a substrate, placing the substrate in a bath comprising at least phosphoric acid and sulphuric acid to produce a thin anodized layer, rinsing the thin anodized layer in a solution, plating a surface of the thin anodized layer in an electro deposition bath following a plating current profile for a predetermined period, and increasing the plating current to the recommended bath plating current to produce the thin film coating having a desired initial coating thickness.

DETAILED DESCRIPTION

Examples described herein provide an improved process to develop a thin plated coating on an aluminium or light metal alloy. The process incorporates one of more of the following steps: degreasing an alloy substrate; electro polishing the substrate; activating the surface; anodizing a film of between 1 and 10 microns on the substrate in an anodizing baths comprising substantially phosphoric acid; optionally activating the anodized surface in a solution containing hydrofluoric acid to completely dissolve the anodized surface end-caps; electro-depositing a first plated layer of between 1 and 20 microns (including the anodizing film) adopting a voltage profile for the electro-deposition to ensure the anodizing pores are completely filled and sealed and develop a surface onto which other coatings may be deposited; optionally a sealing phase using nickel acetate bath may follow the first plating step to seal any anodizing pores not completely filed by the first plating step; and optionally depositing a second, or a multi-layer, functional coating of between 0 and 20 microns on the first layer. The total average thickness of the hybrid coating may be around 2 to 40 microns.

Figure 18:
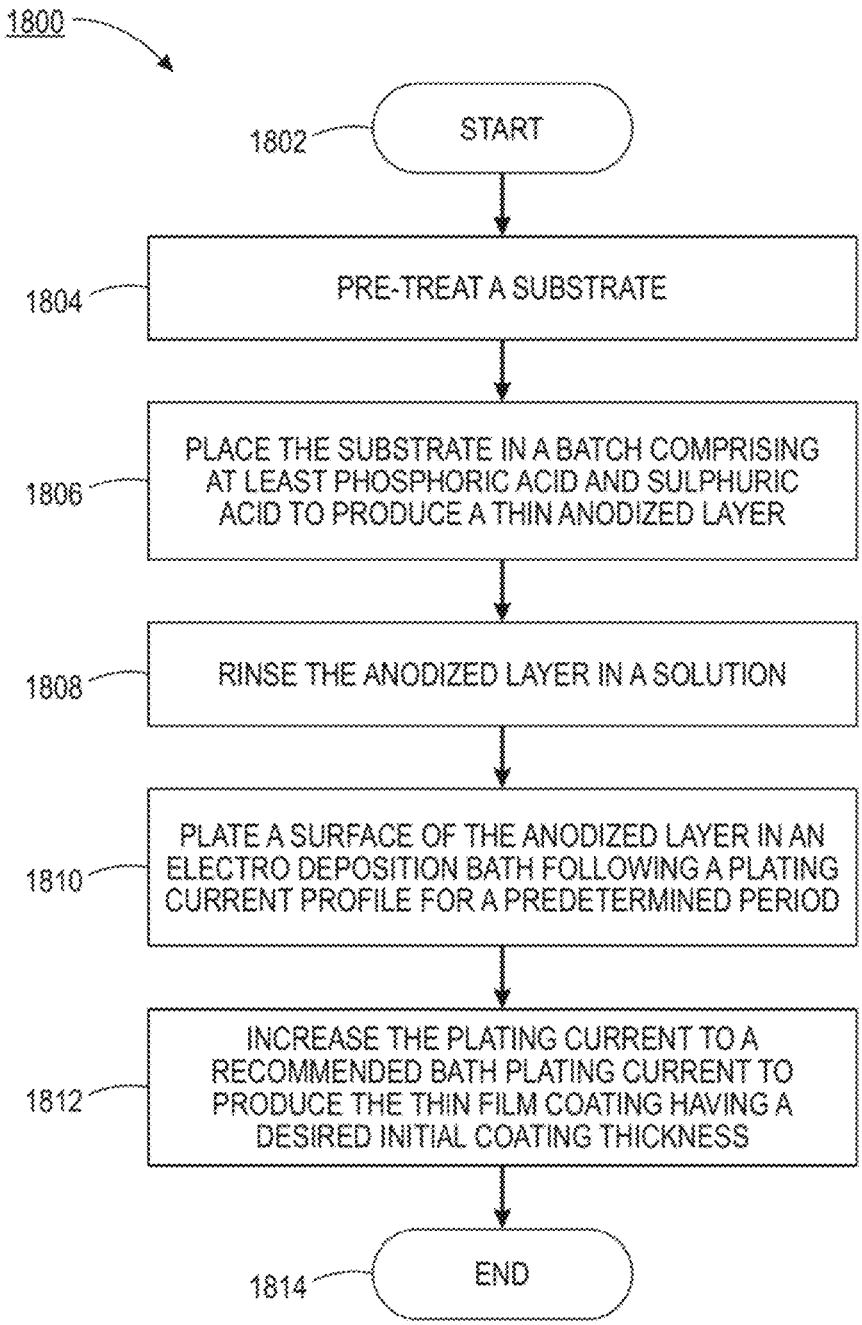
FIG. 18 is a flow chart of an example method for producing a thin film coating.

FIG. 18 illustrates an example method 1800 for producing a thin film coating. In one embodiment, the method 1800 may be performed by various equipment or tools in a processing facility under the control of a processor or controller.

At block 1802, the method 1800 begins. At block 1804, the method 1800 may pre-treat a substrate. In one embodiment, the substrate may be aluminium, titanium, or magnesium.

The pre-treatment may include degreasing the substrate in an alkaline bath, roughening the substrate in a solution of polyethelene glycol, sulphuric acid and hydrofluoric acid, or other similar solution, and etching the substrate in a nitric acid solution. An example of solution may be a commercial aluminum surface pretreatment called Probright AL. The solution to roughen the substrate may clean the substrate surfaces as it etches.

One example of the pre-treatment may include the substrate first being treated by degreasing in a commercial solution such as Activax from MacDermid. The degreasing step is followed by rinsing and electro polishing in a bath containing $H_3PO_4$, HF, $H_2SO_4$ and Glycerol in a volume ratio selected from the following ranges 70-85:2-4:6-9:5-20. The rinsing of the substrate prior to anodizing has the effect of eliminating impurities on the surface, which may cause imperfections in a thin anodized layer. Such impurities include insoluble alloying elements in the substrate. The electro polishing bath is held at a temperature of between 70 and 80 Celsius (° C.) at a voltage (V) of approximately 12V. The electro polishing step provides a uniform surface of the substrate with minimal alloying elements of the surface which contributes to achieving a uniform anodized layer. The electro-polished substrate is then rinsed in de-ionized (DI) water prior to the activation and anodizing step.

In one embodiment, the substrate may be optionally activated prior to anodizing. The activation step may provide some benefits on certain alloys. One example of the activation step may include activating the surface in a bath comprising $HNO_3$ normally 40% by volume, but between 20 and 50 V % can be effective, and between 1 and 10 milliliters per liter (mL/L) of HF. The bath is maintained at a temperature between 20° C.-25° C. with the substrate being immersed and agitated about once per second for between 20 and 40 seconds.

Another example of the activation step may include a short anodizing step for 1 minute or less, also referred to as "patterning." The patterning may improve the quality of the anodizing film. One example includes the removal of the developed anodizing layer in a sodium hydroxide bath, rinsing, and then anodizing again following the anodizing process described herein.

Figure 1:
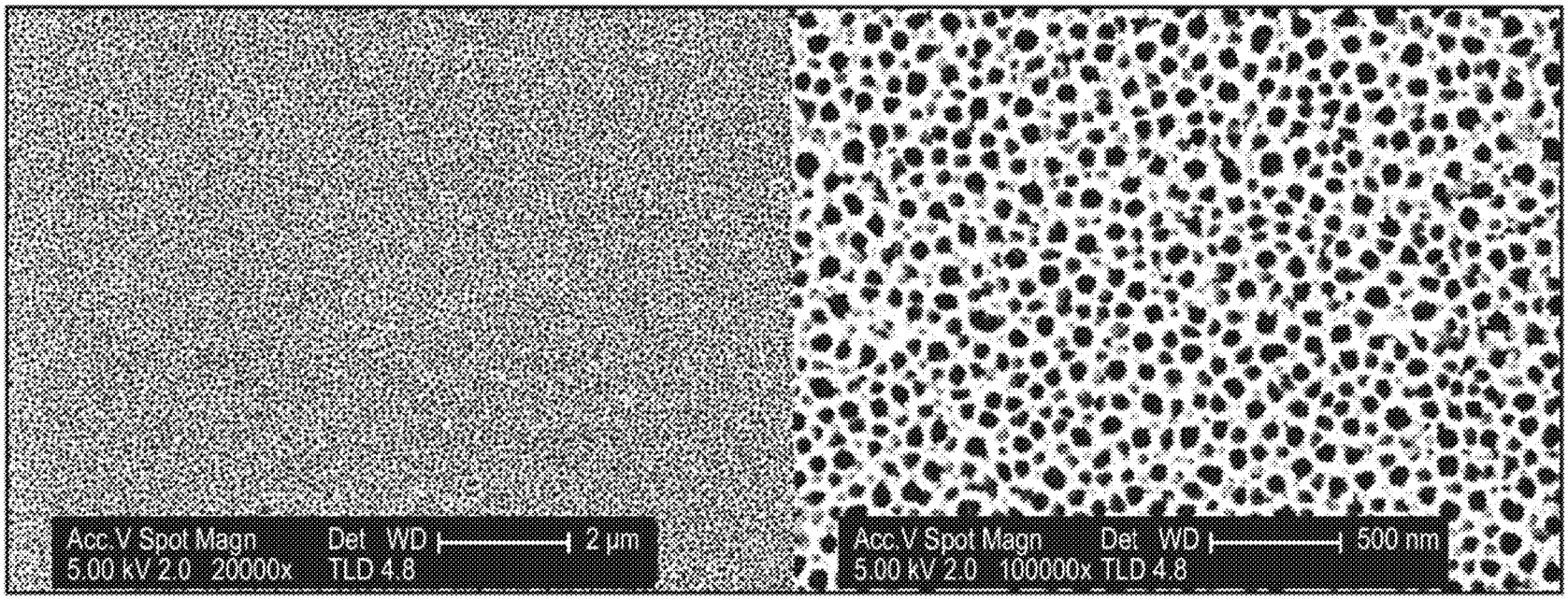
FIG. 1 is a scanning electronic microscope (SEM) image of an anodized surface.

At block 1806, the method 1800 places the substrate in a bath comprising at least phosphoric acid and sulphuric acid to produce a thin anodized layer. In one embodiment, the electrical parameters and bath composition of the anodizing step are carefully controlled to ensure that the anodized surface contains a uniform high-density distribution of thin walled pores between 50 and 70 nanometers (nm) in diameter, as shown in FIG. 1. The anodizing bath which contains principally phosphoric acid with small amounts of both sulphuric and oxalic acids is operated at room temperature (20° C.-25° C.). A bath composition is selected from the range $H_3PO_4$ 280-600 grams per liter (g/L), $H_2SO_4$ 1-15 g/L and HOOCCOOH 1-10 g/L. Constant voltage anodizing at a voltage of between 30V and 60V and a maximum current density of 2 amperes per square decimeter ($A/dm^2$) provides an optimum pore distribution and density. The thickness of the anodized film in the present disclosure is between 1 and 10 microns; however, the thickness may also be between 1 and 5 microns. In one embodiment, the thickness may be between 1 and 2 microns. Anodizing for 10 minutes at the above described conditions results in an anodized film of about 2.5 microns. The thin anodized layer becomes a keying layer for a hybrid coating system allowing subsequently deposited layers to securely interlock with this layer to provide superior adhesion over traditional plated solutions.

Figure 2:
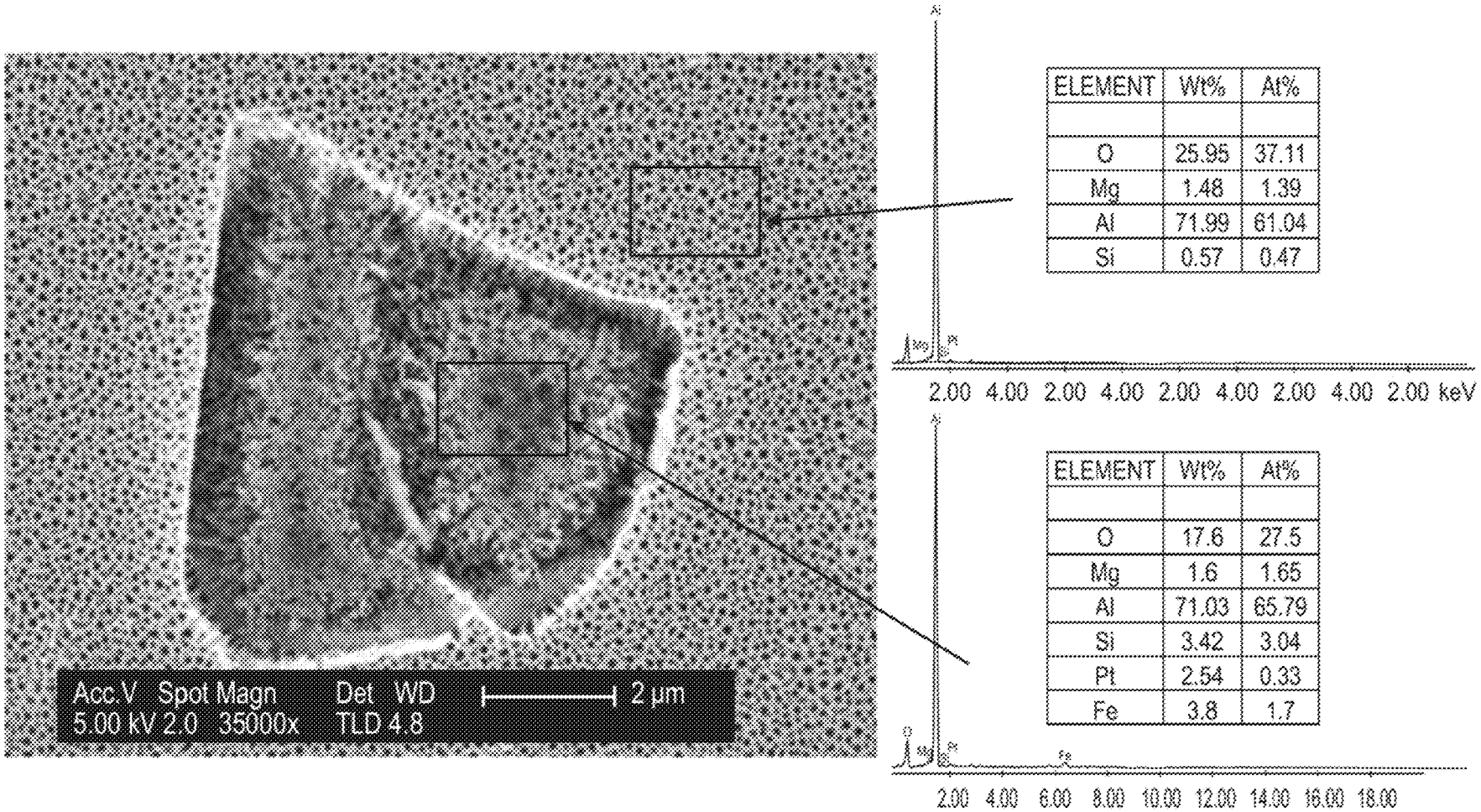
FIG. 2 is a SEM of an anodizing flaw.

A problem to be managed, during the anodizing step, when anodizing thin films, is the incomplete dissolution of some alloying element, such as silicon and iron, from the substrate. The electro polishing and activation steps, prior to anodizing, reduce but do not eliminate the presence of these elements from the surface. The presence of these elements may result in anodizing flaws as shown in the SEM image in FIG. 2. These flaws may create imperfections in the first electrodeposited layer where the first electrodeposited layer either does not completely cover, or does not completely interlock, with the anodized layer resulting in both low adhesion and potential corrosion pathways. The selection of low temperature and low constant voltage anodizing minimizes the creation of such flaws. The optional sealing step may eliminate potential corrosion pathways.

At block 1808, the method 1800 rinses the anodized layer in a solution. In one embodiment, the rinsing may be used to completely dissolve the anodizing end-caps at the bottom of the pores. The solution may be a bath comprising between 0.5-5 mL/L HF. The anodized substrate to be processed is immersed in the rinse bath for approximately 30 seconds while being agitated about once per second.

At block 1810, the method 1800 plates a surface of the anodized layer in an electro deposition bath following a plating current profile for a predetermined period. For example, a first electrodeposited coating is applied to the anodizing film from a bath selected from a range of possible baths. The electrical parameters pertaining to the first electrodeposited coating are controlled where a first plating current is applied for a first plating period comprising a first plating stage and a second plating current is applied for a second plating period comprising a second plating stage. The first electro-deposited layer forms an interlock layer completely filling the pores in the anodised layer securely locking the first electroplated layer to the anodised surface.

Figure 3:
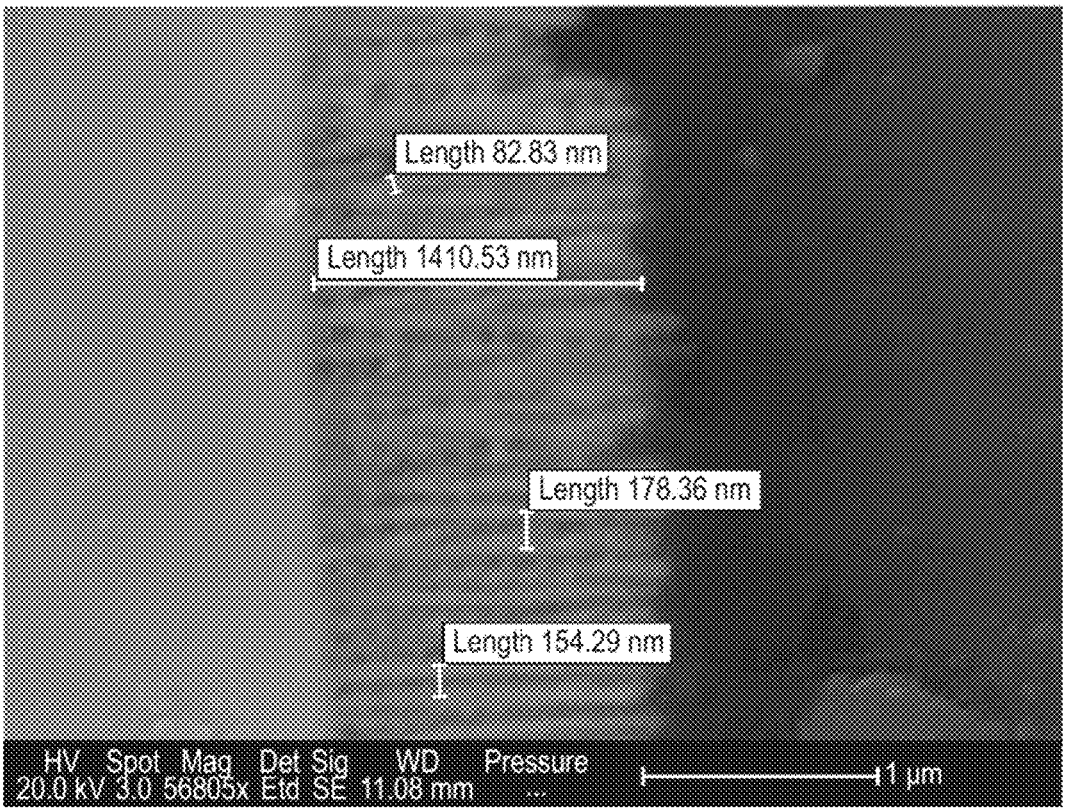
FIG. 3 is a SEM of a filled anodized layer cross-section.
Figure 3:
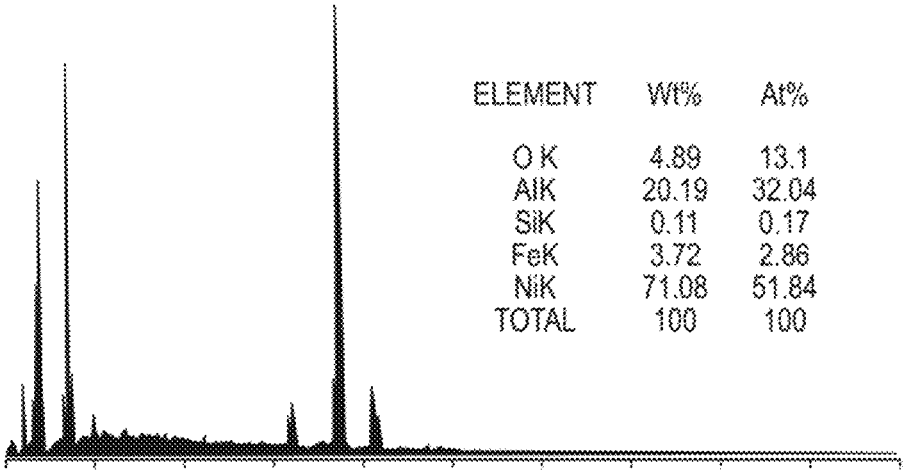

The first plating stage which proceeds for the first plating period during which the first plating current, or current profile, is set at a percentage of the nominal plating current for a chosen bath composition. The nominal plating may be defined by the Technical Data Sheet (TDS) provided by a formulator for a particular plating bath. For example, the plating current for the semi-bright nickel referred to herein may be between 2 and 4 A/dm$^2$. In one embodiment, the nominal plating current may be 3 A/dm$^2$ for the bath described herein. The first plating current, or current profile, is selected to be between 5% and 50% of the nominal plating current for a chosen bath composition and the first plating period is dependent on the thickness of the anodized film, but sufficient to completely fill the anodized pores with an electro deposited coating. The amount of time that is sufficient may be defined by the function below. In one example, for a semi-bright nickel bath and a plating current of 16% of the nominal plating current and an anodizing layer of 2 microns, 18 minutes may provide a sufficient amount of time. The plating rate for this reduced current has been shown to be between 0.05 and 0.5 times that for the bath under normal operating conditions. Thus, the first plating period during which the first plating current is applied is approximately:

$$t = \frac{d}{n * \text{rate factor}},$$

where 't' is the first plating period time in minutes, 'd' is the thickness of the anodized layer in microns and 'n' is the plating rate under normal bath operating conditions for the first electrodeposition bath in microns/minute and rate factor is between 0.06 and 0.3 depending on both the percentage reduction of the current, the normal plating efficiency of the selected plating bath, and the plating rate change with versus current for this bath. FIG. 3 shows a SEM image where the pores of an anodized surface are completely filled following this process. Here the anodized film thickness is 1.4 to 1.5 microns and the rod diameter is between 80-200 nm.

In one embodiment, the first plating current may ramp during the first plating period commencing at 0% of the nominal plating current for a selected plating bath and ramping to 50% of the nominal plating current over a period less than or equal to the first plating period. The thickness formed during the first plating stage may be 1 to 10 microns, which may be same as the thickness of the anodizing film.

At block 1812, the method 1800 increase the plating current to a recommended bath plating current to produce the thin film coating having a desired initial coating thickness. For example, once the pores are filled to a particular level (e.g., less than completely filled, completely filled, more than completely filled, and the like) then the second plating stage commences. During the second stage, the current may remain the same as during the first plating stage, or the current may be immediately increased to the recommended bath plating current. In one embodiment, the recommended bath plating current may be 50% of the lowest nominal current for the selected bath, or the current may be ramped over a period less than, or equal to, the second plating period from the final current used during the first plating stage to 100% of the nominal plating current for the chosen bath. The second plating period is selected to be sufficient to ensure complete coverage of the anodizing film, develop the required plating thickness, develop the required surface morphology and/or achieve other desirable characteristics for the first electrodeposited layer. In one embodiment, the thickness of the second plating state is 1 to 10 microns. At block 1814, the method 1800 ends.

In one embodiment, the first electrodeposited layer will be between 2-20 microns thick, especially if the first electrodeposited layer is the only electro-deposited layer providing all the functional attributes of the plated surface.

Figure 17:
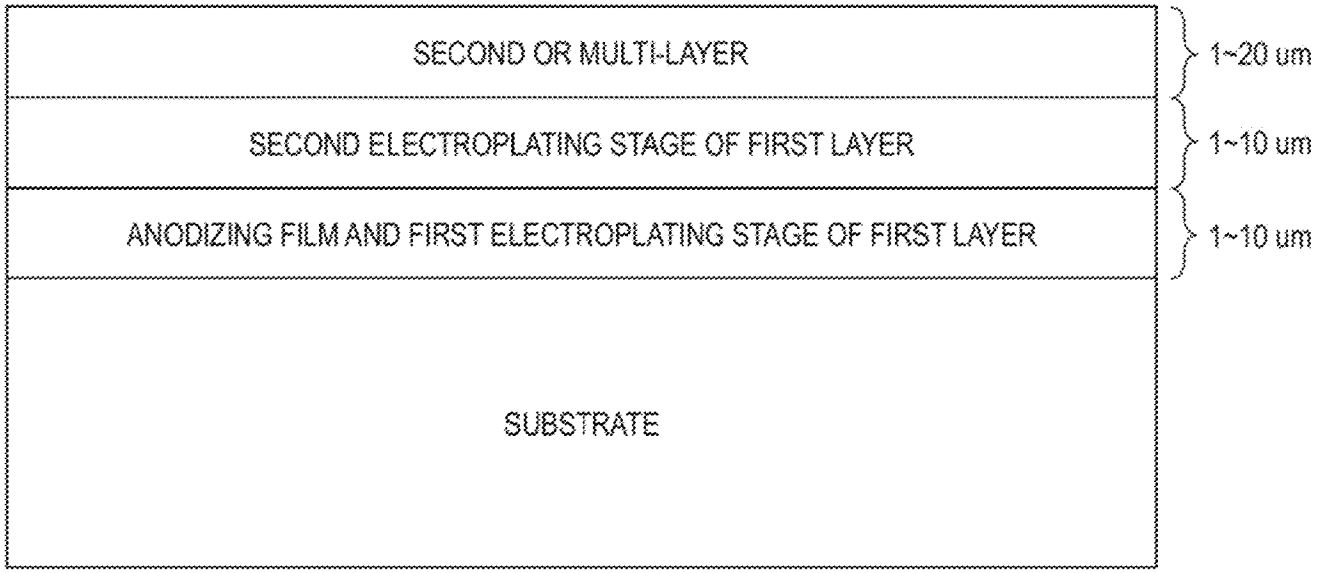
FIG. 17 is an image of example thicknesses of various layers.

In one embodiment, the first electro-deposited coating may be the thickness of the anodising layer. Here the first electro-deposited layer is frequently followed by a second or multi-electro-deposited layer as illustrated in FIG. 17.

In one embodiment, the first electro-deposited layer may be deposited from a bright nickel bath such as R850 supplied by Elite Surface Technology. In one embodiment, the first electro-deposited layer may be deposited from a semi-bright nickel bath such as Chemipure/Niflow supplied by CMP India. In another embodiment, the first electro-deposited layer may be deposited from a copper bath. In another embodiment, the first electrodeposited layer may be deposited from a zinc-nickel nickel bath such as Enviralloy Ni 12-15 supplied by Elite Surface Technology. In another embodiment, the first electrodeposited layer may be deposited from a black bath such that supplied by Elite Surface Technologies. In another embodiment, the first electrodeposited layer may be deposited from a bright nickel bath described above to which between 30-40 g/L of DMAB (dimethylamine borane) is added to obtain a nickel boron first electro-deposited layer. In another embodiment, the first electrodeposited layer may be deposited from other baths such as silver gold, or other metals. In each of these cases the standard plating current and time will be defined by the suppliers of the bath and adapted as described in the current disclosure to ensure complete filling of the pores in the anodized layer and coating the anodized layer with a complete surface of the selected coating.

In one embodiment, the first electro-deposited layer may provide a first functional component of the overall coating system. In particular, the first electro-deposited layer may provide both corrosion protection and a low conductivity to the substrate. In this case the first electro-deposited layer will have a conductivity of <0.1 milliohms (ma) when measured using the procedure specified in Mil DTL 81706.

In one implementation, the first electro-deposited layer may be deposited from a commercial bath such as those proposed above to which a sol of a ceramic phase has been added in a manner described in U.S. application Ser. No. 13/381,487 to provide enhanced functional attributes to the coated surface.

Figure 4:
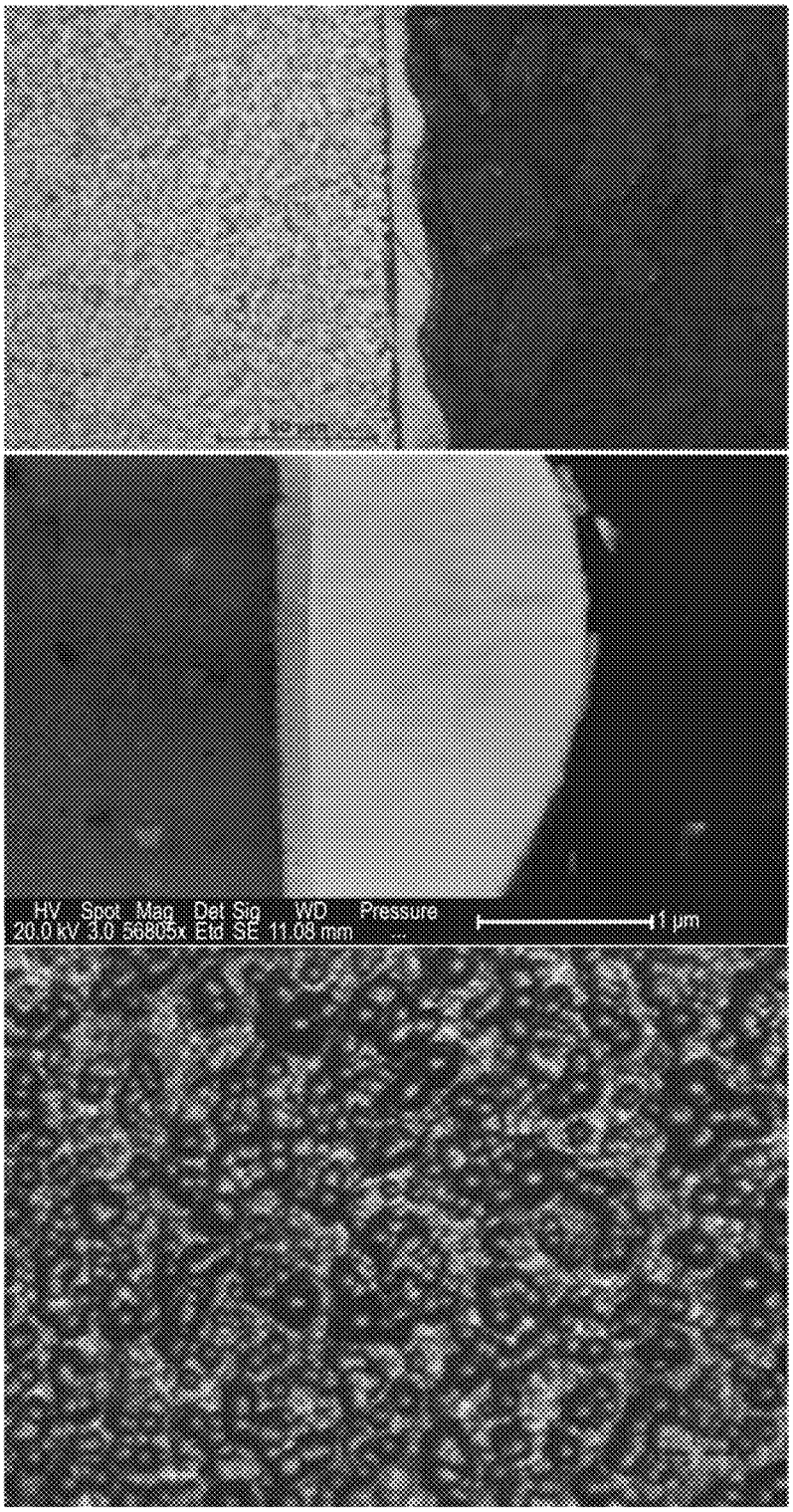
FIG. 4 is an image of a unique morphology.
Figure 5:
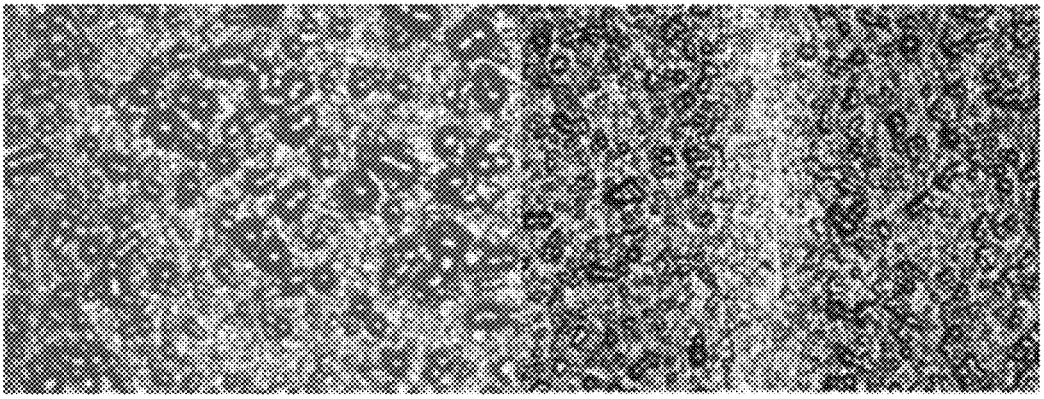
FIG. 5 is an image of example effects of hemispherical surface morphology.
Figure 5:
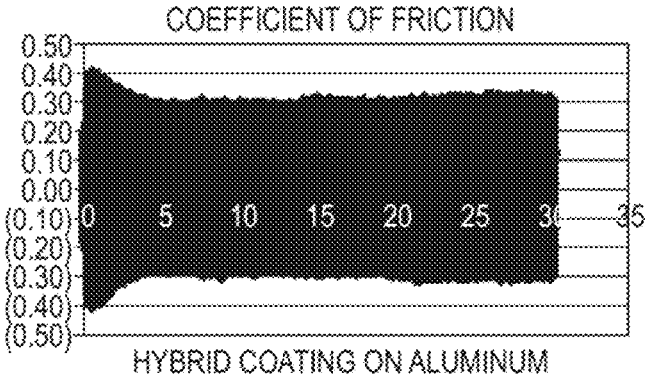
Figure 5:
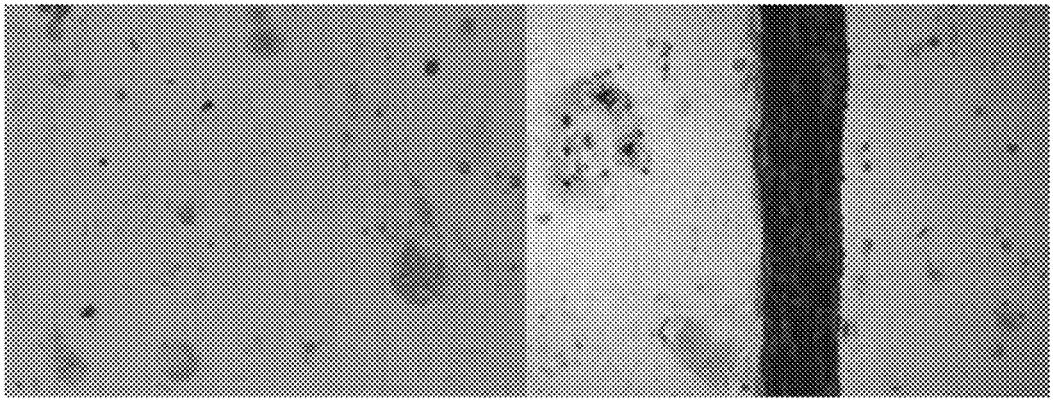
Figure 5:
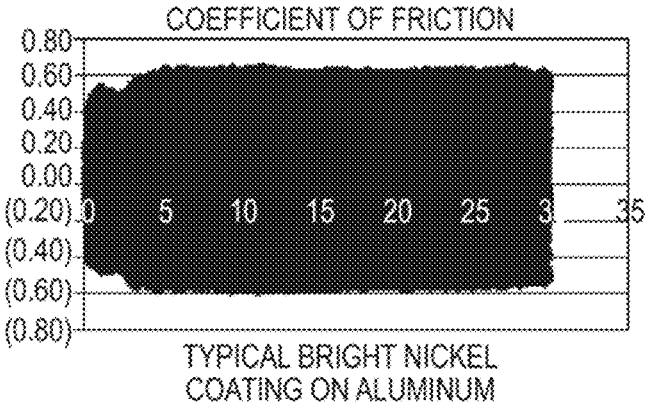

In one embodiment, the anodized film and the first electro-deposited layer is sufficient to provide total required functional properties of the coating system. Here, the first electro-deposited layer arising from certain electro-deposition baths, such as bright nickel, black nickel, or nickel boron, for example, may exhibit an advantageous high surface area morphology arising from the current paths developing through the anodized pores exhibiting a geometric high current low current pattern following the pore structure. Images of the coating cross section and surface morphology of such a structure are shown in FIG. 4. The morphology developed exhibits a surface area at least twice that of a flat plated surface. Such a surface may exhibit improved radiation absorption characteristics, improved wear characteristics, and improved hydrophilic characteristics. FIG. 5 shows some of the desirable characteristics pf this surface morphology, specifically improvements in wear resistance and friction coefficient.

In one embodiment, a first electro-deposited layer may be selected to produce a flat surface. Such a layer is produced by a semi-bright nickel bath such as that provided by CMP Chemicals. The choice of such a first electro-deposited layer provides enhanced corrosion protection of the substrate and provides an excellent surface onto which to deposit a second electro-deposited layer.

In accordance with the current disclosure, any uncoated holes in the first electrodeposited film arising from poorly anodized areas created from undissolved alloying elements in the substrate may be sealed to prevent corrosion in a commercial nickel acetate bath operated at 30-35° C. for 5 to 10 minutes. Such a sealing step may not be required if a second electro-deposited film is to be applied.

In accordance with the current disclosure, a second, or multi-electro-deposited layer, can be applied over the first electrodeposited layer to provide additional functional aspects of the coating. Such a layer may enhance the appearance, hardness, wear resistance, conductivity, etc., of the coating system.

EXAMPLES

The following examples point out specific operating conditions and illustrate the practice of the disclosure. However, these examples are not to be considered as limiting the scope of the disclosure. The examples are selected to specifically illustrate aspects of both a duplex and simplex coating on a thin anodized alloy surface.

Example 1

Hybrid Anodized 6061 Al with Electrodeposited/SB-Ni/Bright Ni

A hybrid coating comprising a thin anodized key layer combined with a semi-bright nickel interlock layer and a bright nickel functional layer offers a thin alternative to a zincate semi-bright nickel, bright nickel plating solution for aluminium. The hybrid coating is thinner that the alternative being approximately 10 microns thick instead of 25 microns; offers superior corrosion resistance (>144 hours CASS versus 75 hours CASS); and has equivalent conductivity.

A 3 centimeters (cm)×5 cm 6061 aluminium specimen was electro polished for a period of 5 minutes in a bath containing $H_3PO_4$, HF, $H_2SO_4$ and Glycerol in a volume 70:2:8:20. The electro polishing bath is maintained at a temperature of 80° C. with a voltage of 12V being applied between the specimen and a Pb cathode.

The electro-polished substrate is then rinsed in DI water prior to the activation and anodizing steps.

The specimen was activated in a bath comprising $HNO_3$ 40% by volume and 5 mL/L of HF. The bath was maintained at a temperature of 20° C. with the substrate being immersed and agitated about 1 per second for a period of 30 seconds.

The specimen was anodized in at 25° C. for a period of 10 mins. The anodizing bath composition was $H_3PO_4$ 300 g/L, $H_2SO_4$ 10 g/L and HOOCCOOH 2 g/. Constant voltage anodizing at a voltage of 60V.

The anodised surface was the activated by immersing the anodized substrate in the bath which contains 1 mL/L HF for 30 seconds while the substrate is agitated about once per second.

Figure 6:
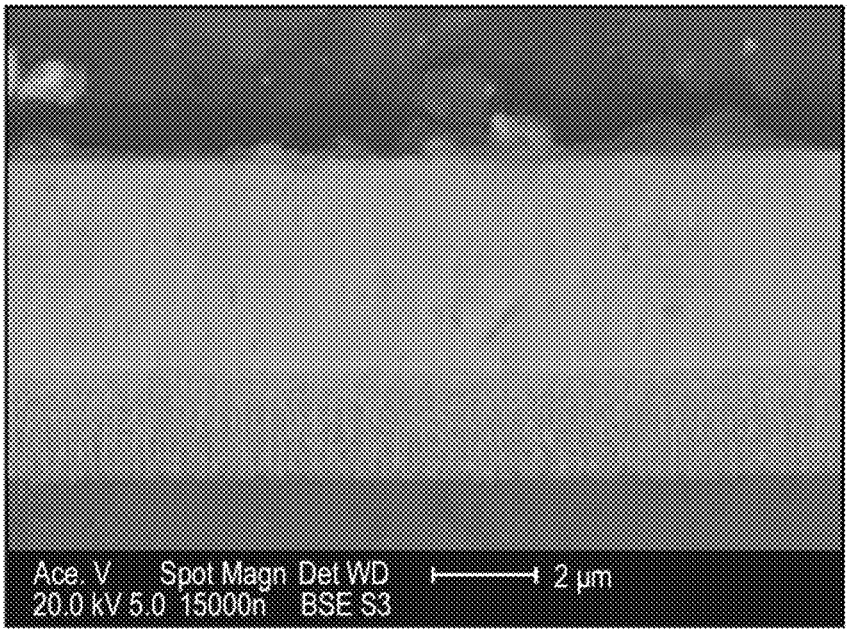
FIG. 6 is an image of a cross-section of a hybrid SB/bright Ni coating.

First electro-deposition stage: Semi-Bright Ni was electroplated through the anodizing film. The current density was selected to be constant at 0.5 A/dm$^2$, compared to a nominal plating current for the selected bath of 2-4 A/dm$^2$, the first plating period was 30 mins. A thickness was approximately 2 microns. Then current density was selected to be constant at 1 A/dm$^2$ for a second plating period of 12 mins. A thickness was approximately 2.4 microns. This first electro-deposited layer attained a thickness was approximately 4.4 microns, being sufficient to completely fill the pores in the anodising film. A second electro-deposited coating was selected to be Bright Ni. Here current density was selected to be 0.51 A/dm$^2$ and a plating period of 8 mins was required. The second electro-deposited layer has a thickness around 1.6 microns. The cross section of the coating created showing the layers may be seen in FIG. 6.

Figure 7:
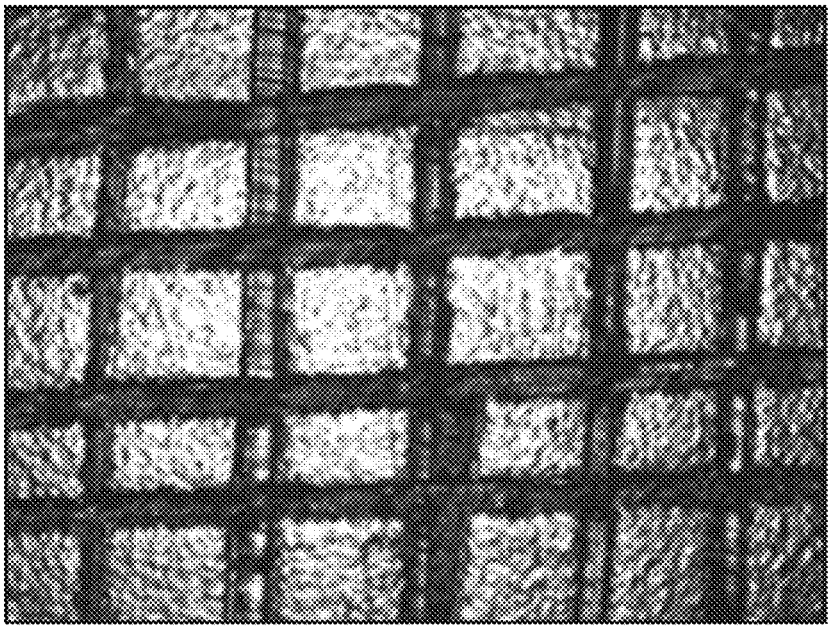
FIG. 7 is an image of an adhesion test of a hybrid SB/bright Ni coating.
Figure 8:
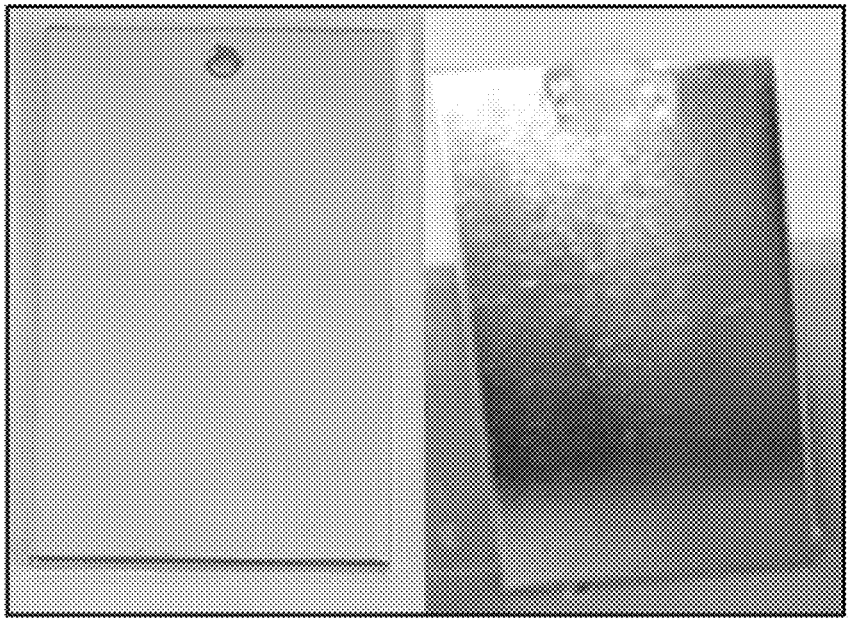
FIG. 8 is an image of pre and post copper accelerated acetic acid salt spray (CASS) testing images.

The resulting deposit was uniformly bright and smooth with excellent adhesion, FIG. 7. The deposit showed a very good corrosion resistance passing 144 hours of Copper Accelerated Salt Spray (CASS) testing (FIG. 8).

Example 2

Hybrid Anodized 6061 Al with Electrodeposited SB—Ni/Zn—Ni

A hybrid coating comprising a thin anodized key layer combined with a semi-bright nickel interlock layer and a Zinc-Nickel functional layer offers a thin alternative to a zincate electroless Ni—P, and electroplated Zinc-Nickel being proposed as a replacement for poisonous hexavalent chrome passivated cadmium coatings used on electrical connectors. The hybrid coating is thinner that the alternative being approximately 20 microns thick instead of 45 microns; offers equivalent corrosion resistance); and has equivalent conductivity.

Anodized/SB-Ni/Zn—Ni n 6061A 3 cm×5 cm 6061 aluminium specimen was electro polished for a period of 5 mins in a bath containing $H_3PO_4$, HF, $H_{25}O_4$ and Glycerol in a volume 70:2:8:20. The electro polishing bath is held at a temperature of 80° C. with a voltage of 12V being applied between the specimen and a Pb cathode.

The electro-polished substrate is then rinsed in DI water prior to the activation and anodizing steps.

The specimen was activated in a bath comprising $HNO_3$ 40% by volume and 5 mL/L of HF. The bath was maintained at a temperature of 20° C. with the substrate being immersed and agitated once per second for a period of 30 seconds.

The specimen was anodized in at 25° C. for a period of 10 mins. The anodizing bath composition was $H_3PO_4$ 300 g/L, $H_{25}O_4$ 10 g/L and HOOCCOOH 2 g/L. Constant voltage anodizing at a voltage of 60V.

The anodised specimen was the activated by immersing the anodized substrate in the bath which contains 1 mL/L HF for 30 seconds while the specimen is agitated about once per second.

A first electrodeposition bath was selected to be Semi-Bright nickel due to its excellent anti corrosion properties. A current profile was chosen for this layer to both fill the anodizing pores and provide a complete covering of the anodized surface. During the first electro-deposition stage, Semi-Bright Ni was electroplated through the anodizing film. The current density was selected to be constant at 0.5 A/dm$^2$, a first plating period of 30 mins was sufficient to completely fill the anodized pores. This first electro-deposited layer thickness was around 2.1 microns. After the first plating period the current was increased to 1 A/dm$^2$ and plating continued for a second plating period of 30 mins. The first electro-deposited layer has a total thickness around 7.0 microns.

A second electro-deposited coating was selected to be ZnNi. The current density was selected to be 1 A/dm$^2$ and a plating period was 40 mins. The second electro-deposited layer has a thickness around 6.9 microns.

Figure 9:
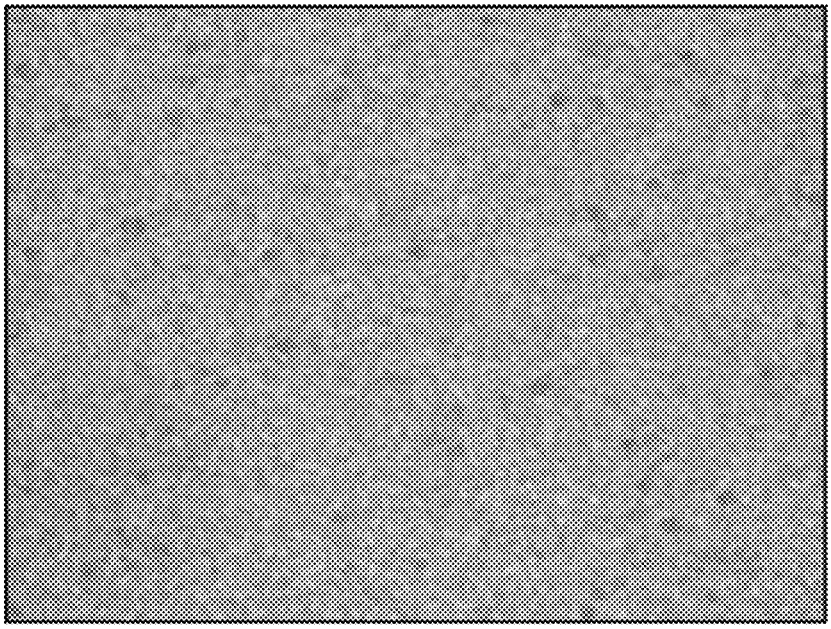
FIG. 9 is an image of a duplex hybrid coating with Zn—Ni surface.
Figure 10:
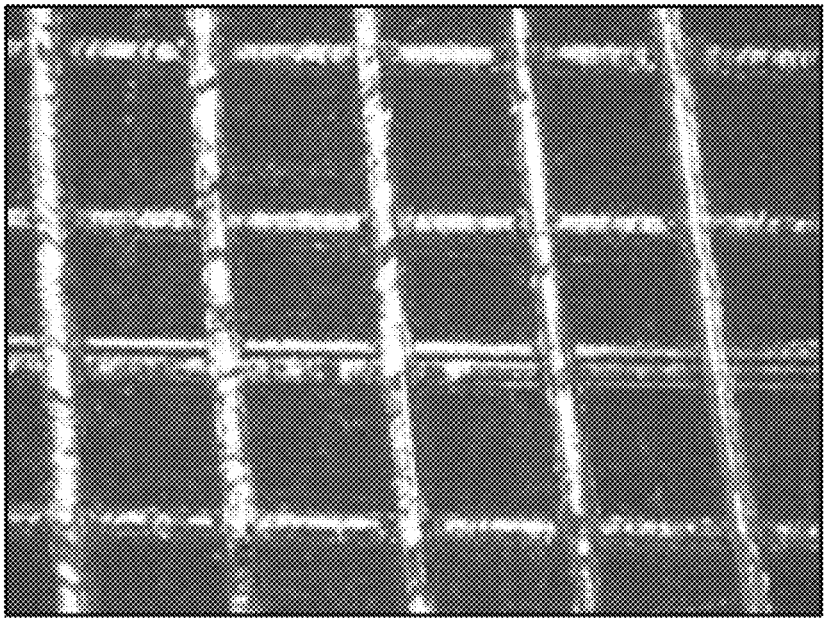
FIG. 10 is an image of adhesion test results for duplex hybrid coating.
Figure 11:
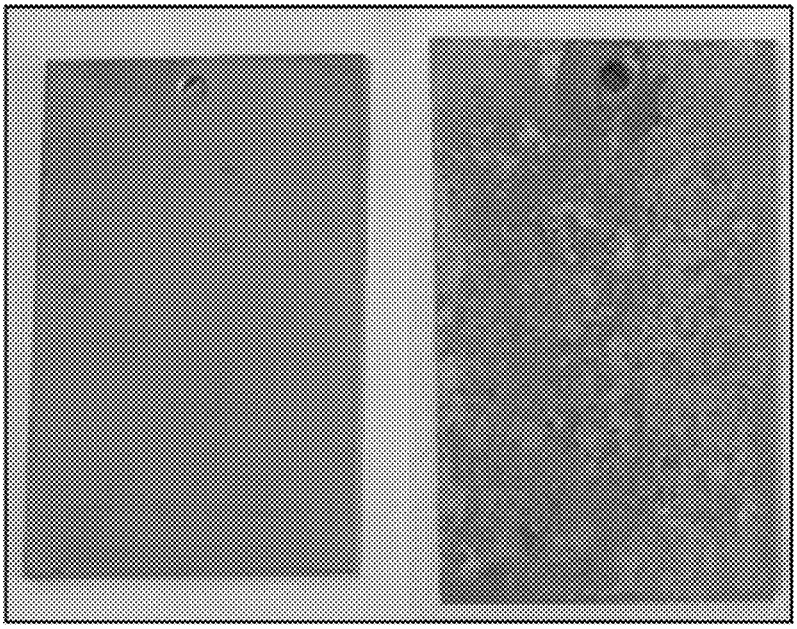
FIG. 11 is an image of pre and post CASS test results for duplex hybrid Zn—Ni coating.

The resulting deposit was uniformly bright and smooth (FIG. 9), and the adhesion of the total electrodeposit to the panel was excellent (FIG. 10). The deposit also showed a very good corrosion resistance, passing 72 hours CASS (FIG. 11).

Example 3

Hybrid Anodized 5251 Al with Electrodeposited Black Ni

A hybrid coating comprising a thin anodized key layer combined with a Black Nickel interlock functional layer offers an alternative to a traditional Black Nickel and Black Chrome coatings on aluminium. The hybrid coating provides several advantages over the existing coatings, including improved wear resistance and improved absorption in the ultraviolet range.

A 2 cm×3 cm 5251 aluminium was electro polished for a period of 5 mins in a bath containing $H_3PO_4$, HF, $H_2SO_4$ and Glycerol in a volume 75:4:6:15. The electro polishing bath is held at a temperature of 80° C. with a voltage of 12V being applied between the specimen and a Pb cathode.

The electro-polished substrate is then rinsed in DI water prior to the activation and anodizing steps.

The specimen was activated in a bath comprising $HNO_3$ 40% by volume and 5 mL/L of HF. The bath was maintained at a temperature of 20° C. with the substrate being immersed and agitated once per second for a period of 30 seconds.

The specimen was anodized in at 25° C. for a period of 10 mins. The anodizing bath composition was $H_3PO_4$ 350 g/L, $H_2SO_4$ 10 g/L and HOOCCOOH 2 g/. Constant voltage anodizing at a voltage of 45V. An anodized layer of between 2 and 2.5 micros was developed.

The anodised specimen was the activated by immersing the anodized substrate in the bath which contains 2 mL/L HF for 30 seconds while the specimen is agitated about once per second.

A black nickel functional layer was electroplated over the anodized surface from commercial black nickel plating bath. The electroplating was performed using a current profile where the current density was increased from 0.8 A/dm$^2$ to 1.25 A/dm$^2$ over the plating period. The sample was plated period required for 20 mins to achieve a total coating thickness of around 5 microns.

Figure 12:
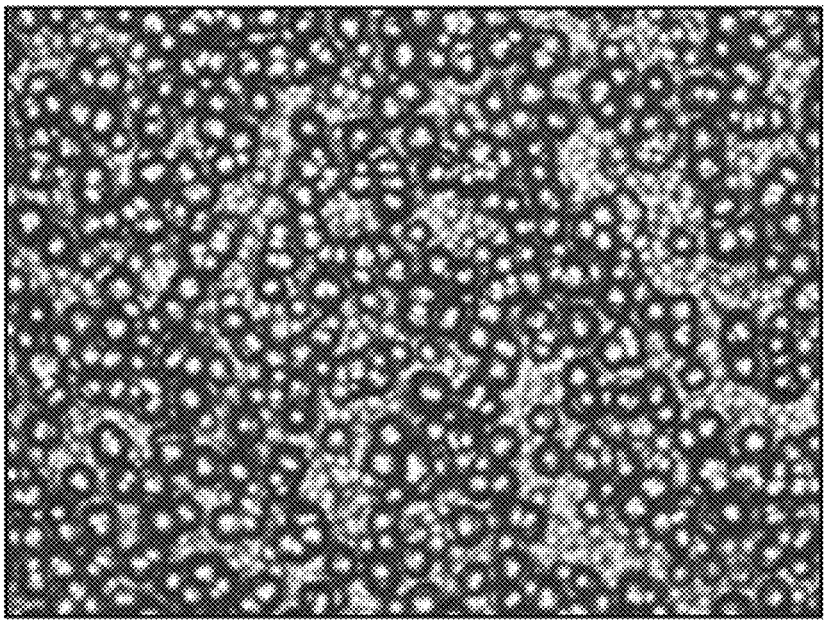
FIG. 12 is an image of a surface morphology of hybrid black nickel coating.
Figure 13:
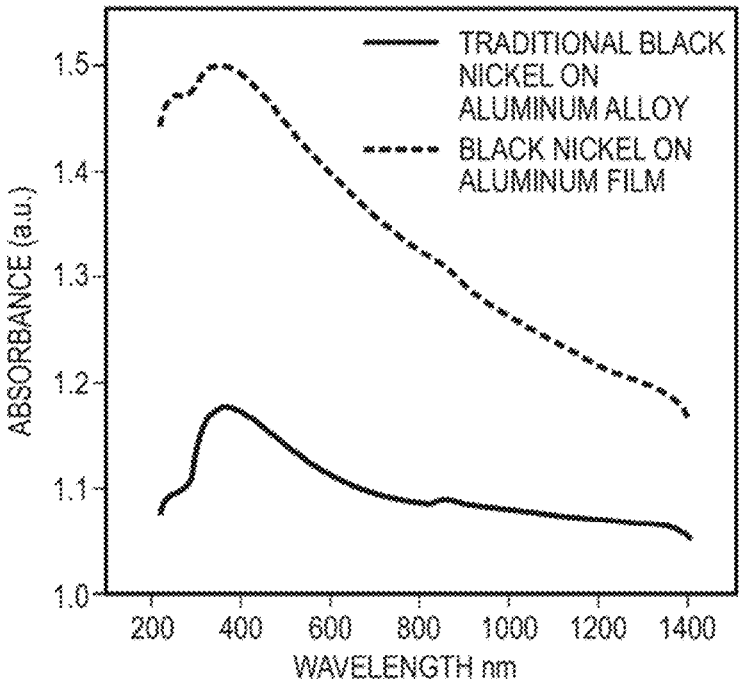
FIG. 13 is an image of UV-Vis-infrared light absorption properties.
Figure 14:
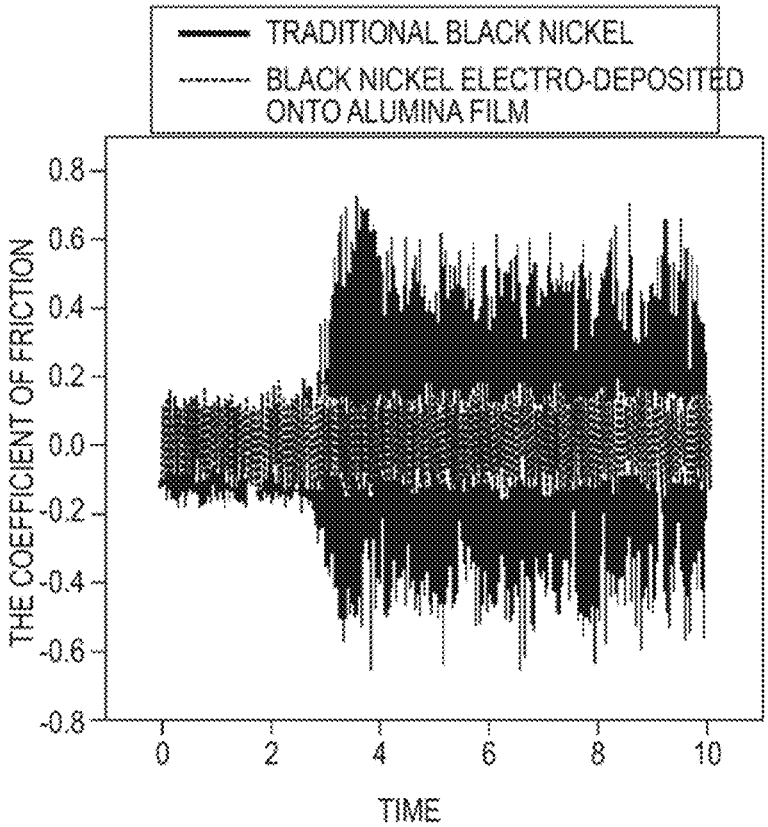
FIG. 14 is an image of wear resistance under 1N load.

The surface morphology of the hybrid black nickel is uniformly nodular (FIG. 12) which creates both excellent good light absorption properties (FIG. 13) and wear resistance properties (FIG. 14), unlike traditional black nickel coatings the adhesion of the coating to the substrate was excellent.

Example 4

Hybrid Anodized 5251 Aluminium Alloy with Electrodeposited Ni—B

A hybrid coating comprising a thin anodized key layer combined with a Nickel Boron interlock functional layer offers an alternative to a traditional hard Chrome. The hybrid coating produces a hemispherical surface morphology with outstanding wear resistance.

A 2 cm×3 cm 5251 aluminium specimen was electro polished for a period of 5 mins in a bath containing $H_3PO_4$, HF, $H_2SO_4$ and Glycerol in a volume 75:4:6:15. The electro polishing bath is held at a temperature of 80° C. with a voltage of 12V being applied between the specimen and a Pb cathode.

The electro-polished substrate is then rinsed in DI water prior to the activation and anodizing steps.

The specimen was activated in a bath comprising $HNO_3$ 40% by volume and 5 mL/L of HF. The bath was maintained at a temperature of 20° C. with the substrate being immersed and agitated once per second for a period of 30 seconds.

The specimen was anodized in at 25° C. for a period of 10 mins. The anodizing bath composition was $H_3PO_4$ 350 g/L, $H_2SO_4$ 10 g/L and HOOCCOOH 2 g/L. Constant voltage anodizing at a voltage of 45V. An anodized layer of between 2 and 2.5 micros was developed.

The anodised specimen was the activated by immersing the anodized substrate in the bath which contains 2 mL/L HF for 30 seconds while the specimen is agitated about once per second.

Nickel boron was electroplated onto the anodized substrate from a commercial bright nickel bath produced by CMP to which 3 g/L of DMAB has been added. Plating was commenced at a low constant current of 0.5 A/dm$^2$ for a period of 10 minutes after which the current as increased to 2 A/dm$^2$ for a period of 20 minutes. A total coating thickness of around 5 microns was developed.

Figure 15:
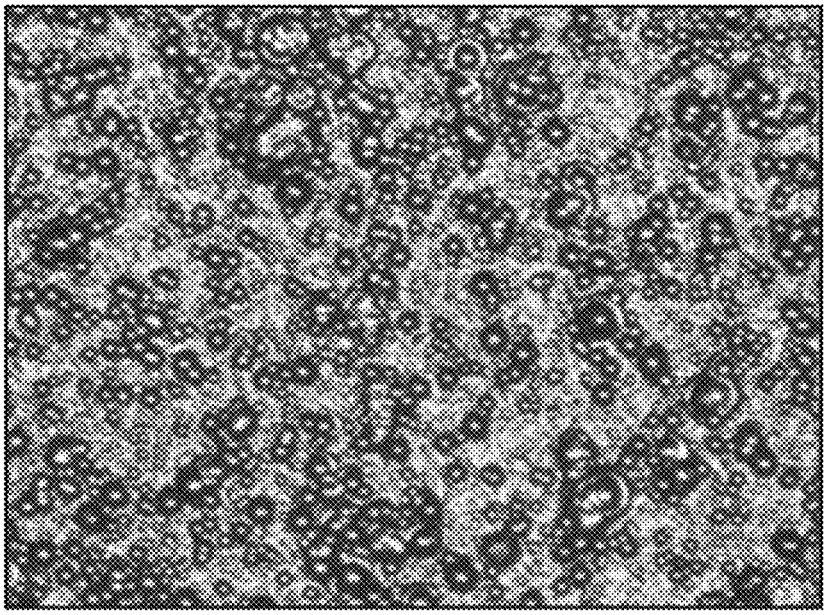
FIG. 15 is an image of a surface morphology of the hybrid black nickel coating.
Figure 16:
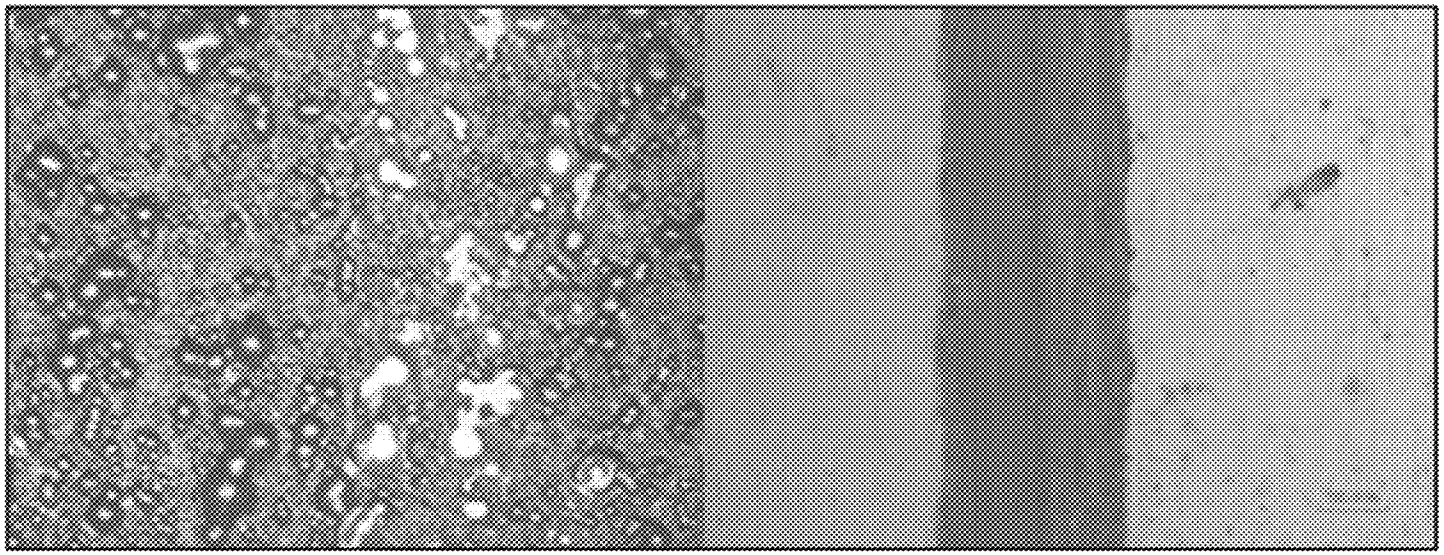
FIG. 16 is an image of comparative wear tracks of a hybrid coating and traditional coating.

The surface morphology of Hybrid Nickel Boron is nodular (FIG. 15) which produces a surface with outstanding wear resistance when compared with traditional coatings (FIG. 16). Under wear conditions, the hemispherical morphology of the extremely hard Hybrid Nickel Boron provides a low friction bearing surface limiting contact between the wear object and the main coating material.

Example 5

Hybrid Anodized Titanium with Electrodeposited Copper

Titanium Dioxide is an important photocatalytic material. A hybrid coating where copper is electrodeposited in the pores of an anodized titanium surface provides an excellent conduction path for electrons released from the $TiO_2$ surface. The hybrid coating technique allows such a surface to be simply created. A titanium sample is electro-polished and activated. An anodized film of between 2 and 3 microns of titanium dioxide is anodized on the surface from an acidic or organic anodizing bath. Copper is preferentially deposited in the pores of the anodizing surface under combination low current pulse plating and low current plating.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

The invention claimed is:

1. A method for producing a coating, comprising:

pre-treating a substrate;

placing the substrate in a bath comprising at least phosphoric acid and sulphuric acid and anodizing the substrate to produce a thin anodized layer;

rinsing the thin anodized layer in a solution;

plating a surface of the thin anodized layer in a single electro deposition bath following a plating current profile for a predetermined period, wherein the plating current profile is selected as a percentage of a nominal plating current that is applied via a direct current or a pulsed direct current, wherein the plating current profile comprises ramping the plating current from 0 to between 0.1 amperes per square decimeter ($A/dm^2$) and 2.0 $A/dm^2$ for a first time period, then holding the plating current constant at a value between 0.1 $A/dm^2$ and 2.0 $A/dm^2$ for a second time period; and increasing the plating current from the value between 0.1 $A/dm^2$ and 2.0 $A/dm^2$ to a recommended bath plating current to produce the coating having a desired initial coating thickness.

2. The method of claim 1, wherein the substrate comprises aluminium.

3. The method of claim 1, wherein the substrate comprises any one of titanium and magnesium.

4. The method of claim 1, wherein the thin anodized layer has a thickness between approximately 2 microns and 10 microns.

5. The method of claim 1, wherein the pre-treating comprises:

degreasing the substrate in an alkaline bath;

roughening the substrate in a solution; and etching the substrate in a nitric acid solution.

6. The method of claim 1, wherein the solution for the rinsing comprises a bath of between 0.5 milliliters per liter (mL/L) to 5 mL/L of hydrofluoric acid.

7. The method of claim 1, wherein the rinsing the thin anodized layer minimizes interference on the coating to produce a uniform film.

8. The method of claim 1, wherein the thin anodized layer is produced at room temperature and at a constant voltage.

9. The method of claim 8, wherein the constant voltage is between 30 Volts (V) and 60V.

10. The method of claim 1, wherein the percentage is selected based on a thickness of the thin anodized layer and a time sufficient to fill anodized pores of the surface that is plated.

11. The method of claim 1, wherein the percentage is between 5% and 50% of the nominal plating current.

12. The method of claim 1, wherein the plating current profile is obtained via a process comprising: holding the plating current constant at the value between 0.12 $A/dm^2$ and 2.0 $A/dm^2$ for the second time period that is sufficient to fill anodizing pores of the surface that is plated; and increasing the plating current to the recommended bath plating current for a third period of time sufficient to provide a uniform coating over the thin anodized layer.

* * * * *